US007617772B2

(12) United States Patent
Lassen

(10) Patent No.: US 7,617,772 B2
(45) Date of Patent: Nov. 17, 2009

(54) BALANCING SYSTEM FOR BALANCING A PRINTING DRUM AND METHOD FOR BALANCING THE PRINTING DRUM

(75) Inventor: Bernd Lassen, Mönkeberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 571 days.

(21) Appl. No.: 11/430,506

(22) Filed: May 9, 2006

(65) Prior Publication Data

US 2006/0254443 A1 Nov. 16, 2006

(30) Foreign Application Priority Data

May 13, 2005 (DE) ..... 10 2005 022 239

(51) Int. Cl.
*B41F 27/12* (2006.01)

(52) U.S. Cl. ..... 101/410; 101/415.1; 101/378; 101/216

(58) Field of Classification Search ..... 101/409, 101/410, 216
See application file for complete search history.

(56) References Cited

U.S. PATENT DOCUMENTS 4,547,810 A 10/1985 Rutherford et al.
5,685,226 A * 11/1997 Fuller ..... 101/415.1
5,813,346 A 9/1998 Solomon
6,116,160 A * 9/2000 Burnett et al. ..... 101/378
6,505,142 B1 * 1/2003 Inoue et al. ..... 702/173
6,640,704 B2 11/2003 Siebolds et al.
2001/0010192 A1 8/2001 Ozaki
2002/0020315 A1 * 2/2002 Siebolds et al. ..... 101/216
2002/0112633 A1 * 8/2002 Fukui ..... 101/477

FOREIGN PATENT DOCUMENTS

DE 10128606 A1 2/2002
EP 1 571 370 A1 9/2005

* cited by examiner

*Primary Examiner*—Leslie J Evanisko
(74) *Attorney, Agent, or Firm*—Laurence A. Greenberg; Werner H. Stemer; Ralph E. Locher

(57) ABSTRACT

In a balancing system and a method for balancing a drum of a printing plate exposer, at least one mass element is provided which can be moved substantially in the circumferential direction of the drum in order to reduce an imbalance of the drum. Previous devices and methods either needed the expertise and the knowledge of a user or external actuators which had to be driven by corresponding devices, for example computers, in order to compensate for an imbalance by moving the mass elements. The balancing system is simple and automatic balancing of the drum is achieved by a mass element being coupled to a positioning element and by its position being adjusted automatically on the basis of the circumferential extent of the printing form.

15 Claims, 7 Drawing Sheets

BALANCING SYSTEM FOR BALANCING A PRINTING DRUM AND METHOD FOR BALANCING THE PRINTING DRUM

BACKGROUND OF THE INVENTION

Field of the Invention

The invention relates to a balancing system for balancing a drum of a printing plate exposer. The balancing system has at least one mass element which can be moved substantially in the circumferential direction of the drum in order to reduce an imbalance of the drum, and at least one movable positioning element whose position correlates with the circumferential extent of a printing form held by the drum. Furthermore, the invention relates to a method for balancing the drum which is suitable for holding flat objects, in particular printing forms. Finally, the invention also relates to a printing plate exposer containing an appropriate balancing system which is suitable for carrying out the inventive method.

A printing plate exposer, in particular an external drum printing plate exposer, has a drum for holding printing forms, in particular printing plates. A corresponding drum is generally suitable to hold printing plates of different formats, that is to say in particular different lengths. In this case, the length meant here is the definitive extent of the printing plate in the circumferential direction of the drum. For the purpose of imaging, the printing plates can be selected from a specific portfolio or repertoire of different printing plates having different formats and/or materials. The different printing plates in this case have different weights in particular in addition to their different circumferential extent. As a result of the interaction between their extent and their mass, when they are clamped onto the drum, they lead to different imbalances of the drum of the printing plate exposer.

In order to compensate for the imbalances, it is known for mass elements to be displaced circumferentially along a path which generally has a constant radial distance from the axis of the drum. The circumferential position of the mass element or various mass elements is in this case adjusted on the basis of the imbalance generated by the printing plate. In order to adjust a mass element, in this case external gripping elements are provided which engage in a corresponding mass element, then move it appropriately to the desired balancing position and arrange for it to latch into a suitable receptacle there. These gripping elements have to be activated accordingly. This is either necessary via a user, who himself becomes active and adjusts a mass element to a desired position by the gripping elements, or external actuators are needed. In order to control these actuators or, more generally, to determine the necessary positions of the mass elements, it is then necessary that a user knows the necessary positions of the mass elements on the basis of the imbalances which occur or that there is a computer with appropriate detection devices and control devices, which drives the actuators in such a way that the mass elements are moved to positions which reduce the imbalances of the drum or cancel them entirely. Corresponding devices and methods have been proposed, for example in published, non-prosecuted German patent application DE 101 28 606 A1 (corresponding to U.S. Pat. No. 6,640,704) and U.S. Pat. No. 5,813,346.

The devices and methods described from the prior art either need the expertise and the knowledge of a user or external actuators, which have to be driven by appropriate devices, for example computers. For this purpose, either tables with the necessary positions of the mass elements are needed, or the positions which are necessary in order to reduce the imbalances first have to be calculated and determined. These are quite complicated procedures which are complicated to carry out.

SUMMARY OF THE INVENTION

It is accordingly an object of the invention to provide a balancing system for balancing a printing drum and a method of balancing the printing drum which overcome the above-mentioned disadvantages of the prior art devices and methods of this general type, which is less complex and simpler to handle than the corresponding devices and methods from the prior art.

With the foregoing and other objects in view there is provided, in accordance with the invention, a balancing system for balancing a drum of a printing plate exposer. The balancing system includes at least one movable mass element moving substantially in a circumferential direction of the drum to reduce an imbalance of the drum, and at least one movable positioning element having a position correlating with a circumferential extent of a printing form held by the drum. The at least one movable mass element is coupled to the at least one movable positioning element such that a circumferential position of the at least one movable mass element is adjusted automatically on a basis of the circumferential extent of the printing form.

The object of the invention is achieved by a balancing system which is constructed in such a way that at least one movable mass element is coupled to the at least one movable positioning element in such a way that its circumferential position is adjusted automatically on the basis of the circumferential extent of the printing form.

Advantageously, a calculation is no longer needed in order to clamp the printing form in this case. Without taking any account of the actual mass of the printing form, the positioning element is adjusted on the basis of the extent of the printing form. In the process, the mass element is also adjusted in a corresponding way, the position of the mass element advantageously depends directly on the position of the positioning element. Thus, there is no longer any free parameter which necessarily has to be known in order to adjust the mass element. The only parameter which influences the position of the mass element is the format of the printing plate. If the printing plate has a circumferentially greater extent, then the mass element is also displaced circumferentially. The position relative to the positioning element is, however, maintained by the mass element. This relative position of the mass element in relation to the positioning element is selected such that the resultant residual imbalance of the drum with the printing plate, which can be selected freely from a predetermined printing plate repertoire, remains below a maximum value.

Advantageously, provision is further made for the at least one movable positioning element to be a plate end clamp, whose position is beneficially automatically linked with the circumferential extent of the printing form.

Furthermore, provision is beneficially made for a second movable positioning element to be a plate start clamp. The relative position of plate start clamp and plate end clamp are advantageously directly dependent on the format of the selected printing form.

Coupling the mass element to the positions of plate end clamps and/or plate start clamps therefore always leads directly to a position on the basis of the circumferential extent of the printing form. In this way, by a suitable selection of the mass of the mass element and the relative position in relation to the plate end clamps and/or the plate start clamps, the residual imbalance of the drum with printing form can in each case be kept below a maximum value.

Furthermore, provision is advantageously made for a driver, which is coupled to at least one positioning element, to adjust the position of the at least one movable mass element.

In this case, the mass element can advantageously be ring-shaped or else disk-shaped, it then having an eccentric mass center of gravity. The eccentric mass center of gravity can in this case also be generated in particular by a body being fitted directly to a ring or a disk.

In order to adjust a corresponding mass element in a simple way as far as possible, provision is made for the at least one movable mass element to be provided on at least one end of the drum. In particular, provision can be made for appropriate movable mass elements, which can be displaced by positioning elements, to be provided on both ends of the drum. In this case, provision can also be made for these mass elements with the appropriate coupling to the positioning elements to be fitted subsequently to an already existing drum.

Beneficially, provision can also be made for at least a second fixed mass element, which is provided fixedly, to reduce the imbalance of the drum without a printing form. In this case, the second mass element can in particular be implemented in the same way as the first movable mass element. It is beneficially able, for example, to compensate for the inherent imbalance of the drum and/or to compensate for the imbalance of the drum with existing plate start clamps or the like.

Advantageously, the position and the mass of the second fixed mass element should be provided in such a way that the maximum imbalance of the drum with a printing form of an envisaged format decreases.

In this case, an envisaged format is to be understood as a format which covers a repertoire or portfolio of printing plates which, as envisaged, are to be imaged with this printing plate exposer.

In a particularly beneficial embodiment of the invention, provision is made for the at least one movable mass element to be adjusted in such a way that, as a result of the superimposition of the compensating imbalances which are caused by the at least one movable mass element and the at least one second fixed mass element, the resultant imbalance of the drum with any desired printing form provided for use in each case remains below an envisaged maximum imbalance.

In this case, a printing form provided is a printing form from a repertoire of printing forms which are to be imaged with the exposer. The balancing system can in this case be provided in particular such that the second fixed mass element keeps the imbalances of all the printing plates provided below the maximum value and the movable imbalance of the movable mass element is adjusted in such a way that the resultant maximum imbalance is reduced still further.

Here, the reduction is to be made in such a way that, beneficially, the product Q of eccentricity E and angular velocity W of the drum for all the printing forms provided remains below a value of 4 mm per second. In this way, the imaging can proceed without difficulty.

The method for balancing the drum with a printing plate or a printing form is provided such that, in a first step, the distance between printing plate end clamps and plate start clamps for holding a printing form of a first format is adjusted. The movable at least one mass element is automatically adjusted circumferentially by the adjustment of at least one plate end clamp and/or plate start clamp by a driver which is coupled to the at least one plate end clamp and/or plate start clamp such that the imbalance of the drum with the printing form of the first format is reduced. In a following step, the distance between the printing plate end clamps and the plate start clamps for holding a printing form of a second format is adjusted. The at least one movable mass element is adjusted at least circumferentially by the adjustment of the plate end clamp and/or plate start clamp such that the imbalance of the drum with the printing form of the second format is likewise reduced and the resulting imbalances of the drum both with the printing form of the first format and with the printing form of the second format in each case lie below a maximum imbalance.

The formats of the first and/or of the second printing form are in this case selected from a printing form repertoire or a portfolio of printing forms or printing plates. The repertoire contains all the printing plates or printing forms which are provided for the plate exposer. In order to reduce the maximum imbalance, provision is made in this case for a fixed and a movable imbalance, which are caused by a fixed and a movable mass element, to act on the drum in such a way that, overall, the resultant imbalance with all the printing form formats provided lies below a maximum value.

Advantageously, a corresponding balancing system for reducing the resulting imbalance of a drum with printing plates is likewise claimed independently.

Other features which are considered as characteristic for the invention are set forth in the appended claims.

Although the invention is illustrated and described herein as embodied in a balancing system for balancing a printing drum and a method of balancing the printing drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
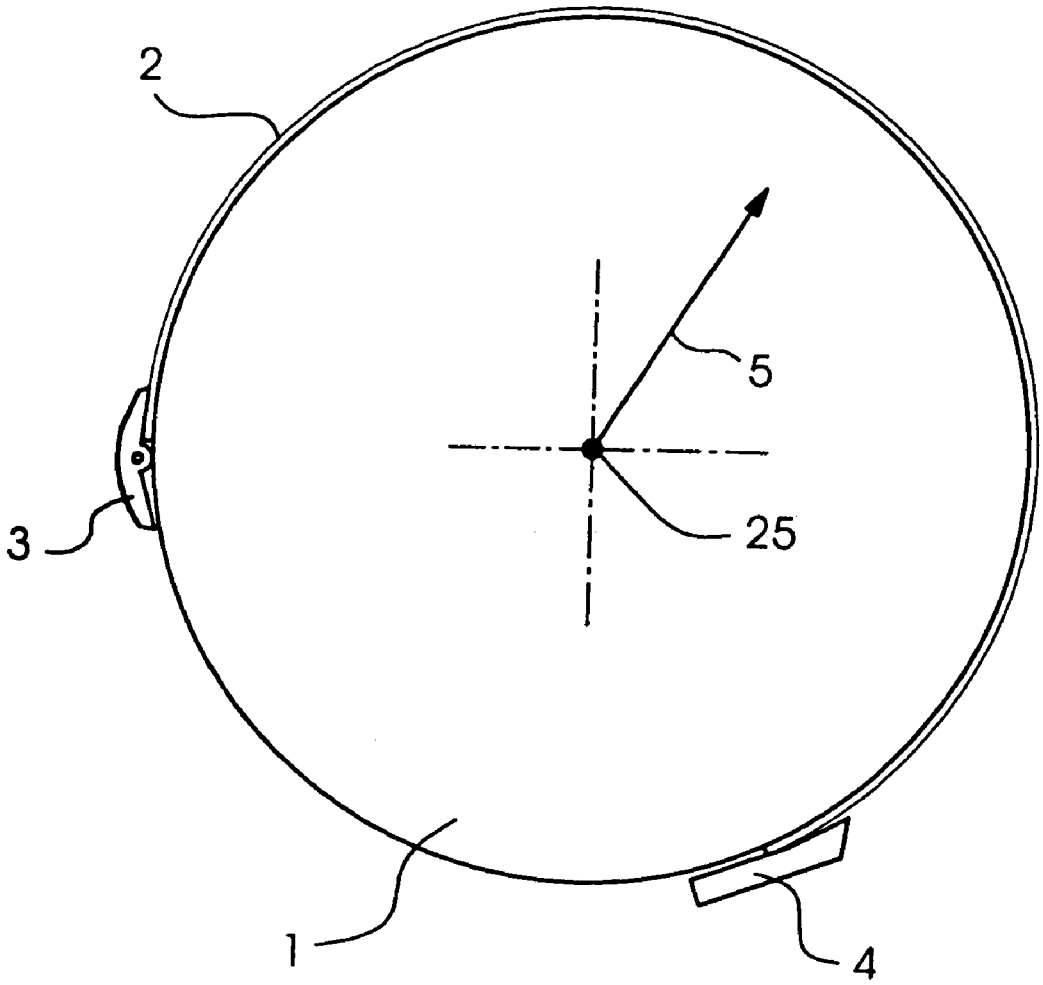
FIG. 1 is an illustration showing an imbalance of a printing plate on a drum of a plate exposer.

Referring now to the figures of the drawing in detail and first, particularly, to FIG. 1 thereof, there is shown an imbalance 5 of a printing plate 2 on a drum 1 of a plate exposer in the form of a sketch. The printing plate 2 is in this case clamped in between start clamps 3 and end clamps 4. In the case illustrated here, the start clamps 3 are provided in a stationary manner on a surface of the drum 1, while the end clamps 4 can be adjusted variably circumferentially. Their position is matched to the format of the printing plate 2. There are in each case a large number of end clamps 4 and start clamps 3, which are fixed axially to the surface of the drum 1 and which are all displaced together. As illustrated in FIG. 4, the outer plate end clamps, which are provided at the ends of the drum 1, are always connected to variable mass elements 11 and 12 via drivers 15. See FIG. 3 and FIG. 4.

In the case of the printing plate 2 on the drum 1 illustrated in FIG. 1, the imbalance 5 of the printing plate 2 is not compensated for by a variable or fixed imbalance.

Figure 2:
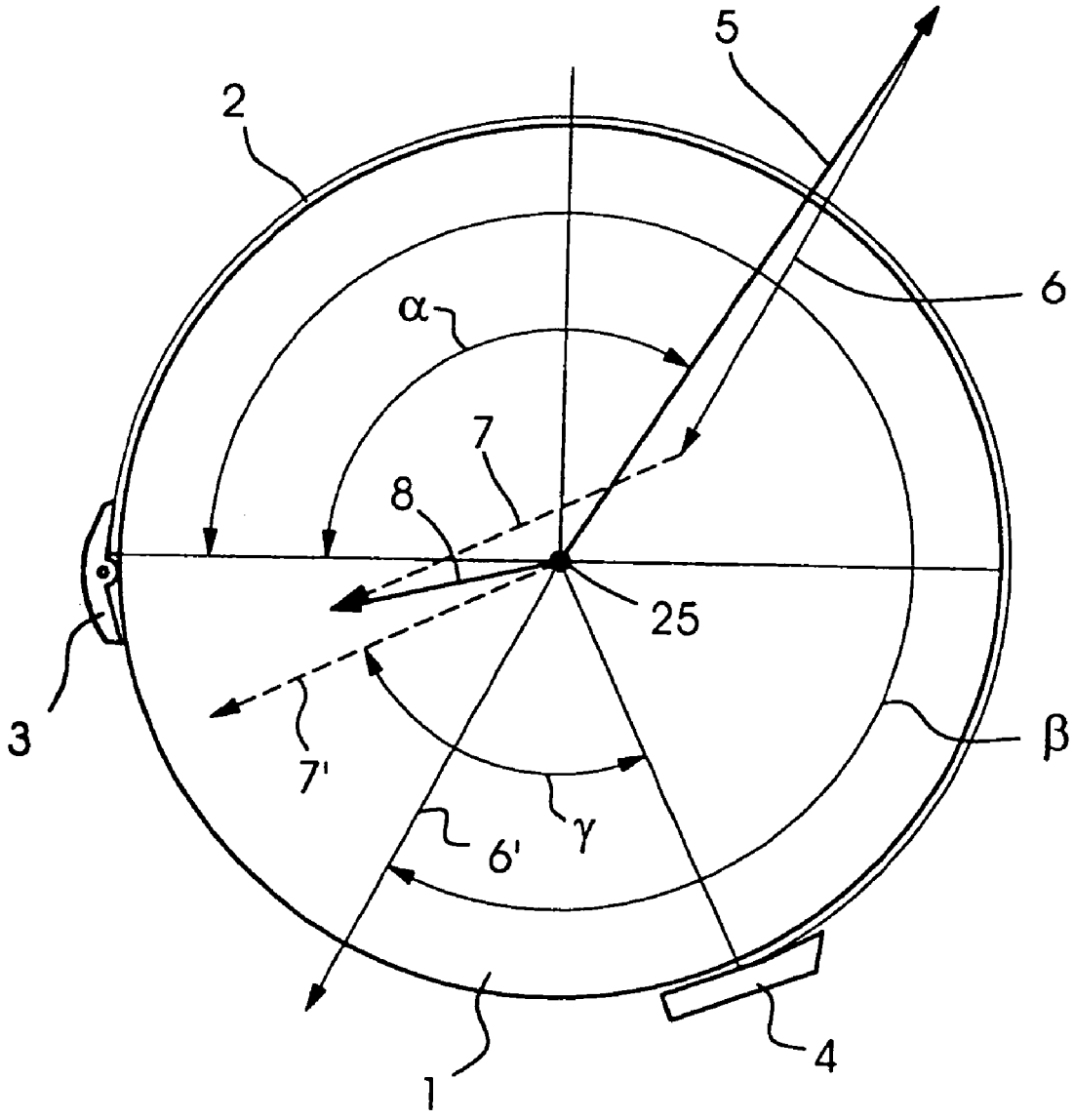
FIG. 2 is an illustration showing a reduction of the imbalance of the drum by use of variable and fixed mass elements according to the invention.
Figure 3:
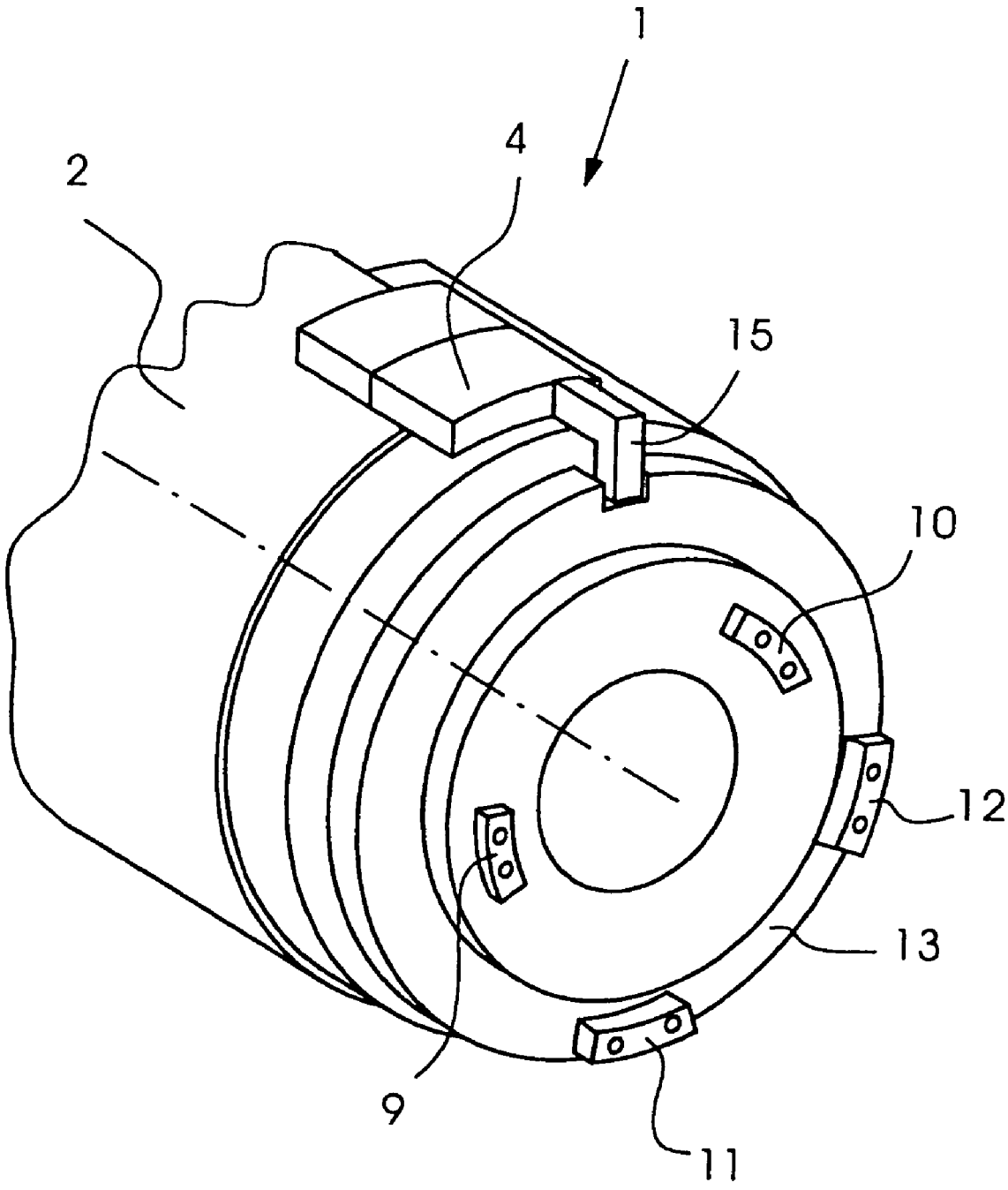
FIG. 3 is a diagrammatic, perspective side-elevational view of the drum with the fixed variable mass elements.
Figure 4:
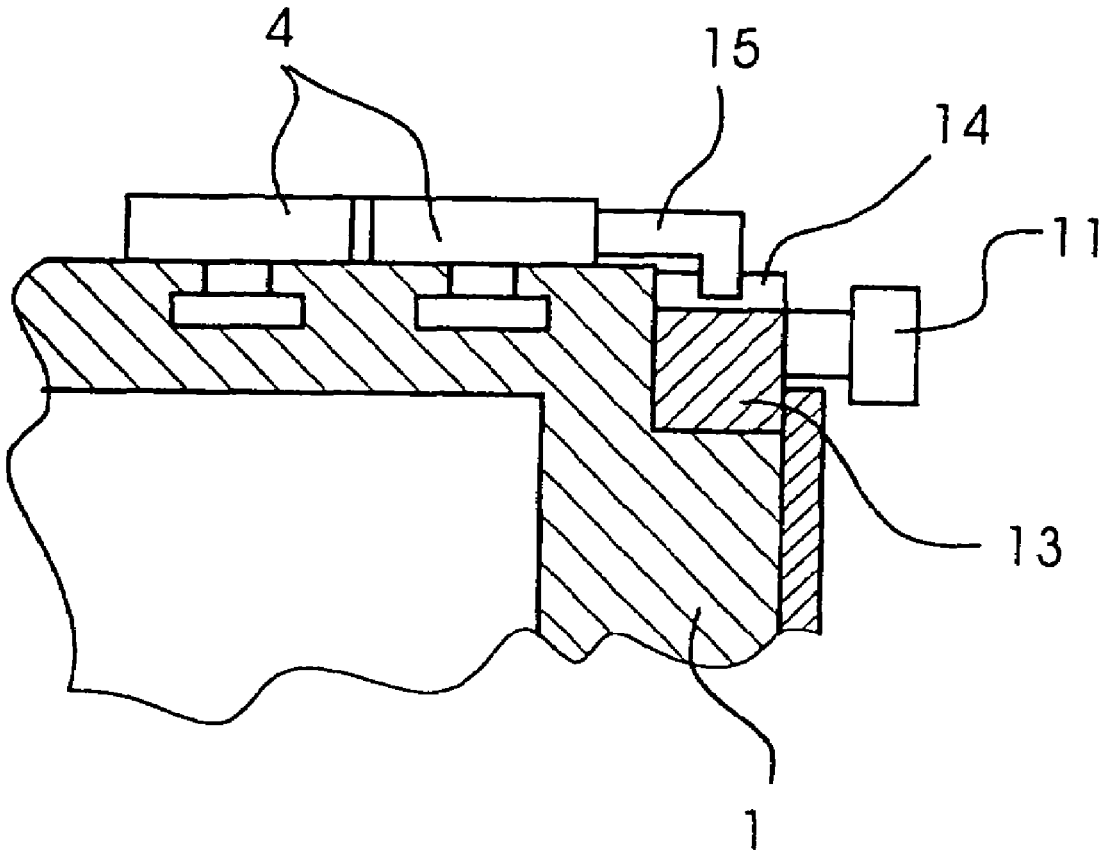
FIG. 4 is a diagrammatic, sectional view of plate end clamps with drivers for the adjustment of variable mass elements.

FIG. 2 shows a corresponding reduction in the imbalance 5 of the printing plate 2 according to FIG. 1 by use of variable mass elements 11, 12 and fixed mass elements 9, 10, as shown in FIG. 3.

The mass elements 11, 12 are fitted to a ring-shaped balance ring 13, as shown in FIG. 3. By the driver 15, the mass elements 11, 12 are then rotated in accordance with the positioning of the plate end clamps 4. By the variable mass elements 11, 12, overall a variable imbalance 7' in relation to a drum center 25 is produced (FIG. 2).

As likewise illustrated in FIG. 3, the fixed mass elements 9, 10 are also provided at the end of the drum 1. As can be seen in FIG. 2, these produce a fixed imbalance 6' in relation to the drum center 25.

The imbalance 5 of the plate 2 is reduced by the fixed imbalance 6 and the variable imbalance 7 to such an extent that only a residual imbalance 8 remains.

The plate imbalance 5 encloses an angle $\alpha$ with the start of the plate 2, which is held by the start clamps. The angle between the variable imbalance 7' and the plate end clamps 4 is in this case constantly an angle $\gamma$. Given a uniform mass distribution of the printing plate 2, the angle between the variable imbalance 7' and the plate start of the plate 2 is therefore two $\alpha$ plus $\gamma$. The alignment of the variable imbalance 7' therefore depends only on the circumferential length of the printing plate 2.

The fixed imbalance 6' encloses a constant angle $\beta$ with the plate start clamps 3. Here, the start clamps 3 are not intended to be movable. The magnitude of the fixed imbalance 6' is in this case configured such that it reduces a maximum imbalance of a printing plate 2 provided. In particular, the imbalance caused by the start clamps 3 also being taken into account.

FIG. 3 shows a corresponding side view of the drum 1 with fixed mass elements 9 and 10 and variable mass elements 11 and 12.

As already outlined, the variable imbalance 7' results from the variable mass elements 11 and 12, and the fixed imbalance 6' results from the fixed mass elements 9 and 10. As mentioned, the mass elements 11 and 12 are provided on the balance ring 13. The balance ring 13 is coupled to the end clamps 4 via the drivers 15.

The variable mass element 11 is in this case positioned on the balance ring 13 in such a way that it compensates for the end clamps 4 in each case. It has an appropriate mass for this purpose. On the other hand, the mass element 12 is positioned in such a way and has such a high mass that it reduces the printing plates 2 provided from a printing plate portfolio provided for the plate exposer in each case overall below a maximum residual imbalance value.

The fixed mass element 9 in the case illustrated here is positioned in such a way and its mass is selected in such a way that overall it cancels the imbalance which is caused by the start clamps 3. The second fixed mass element 10 is in this case positioned in such a way and has an appropriate mass such that overall the resultant residual imbalance of the printing plates 2 from the printing plate portfolio provided remains below a maximum residual imbalance value.

In FIG. 4 it is shown how the end clamps 4 are coupled via the driver 15 to the balance ring 13 which carries the variable mass elements 11 and 12. In order to adjust the variable imbalance 7', the driver 15 engages in an engagement or groove 14 in the balance ring 13. As a result, a circumferential adjustment of the plate end clamps 4 leads directly to a corresponding positioning of the variable imbalance 7', that is to say the variable mass elements 11 and 12. The relative position of the variable mass elements 11 and 12 in relation to each other and to the end clamps 4 is maintained in this case.

Figure 5:
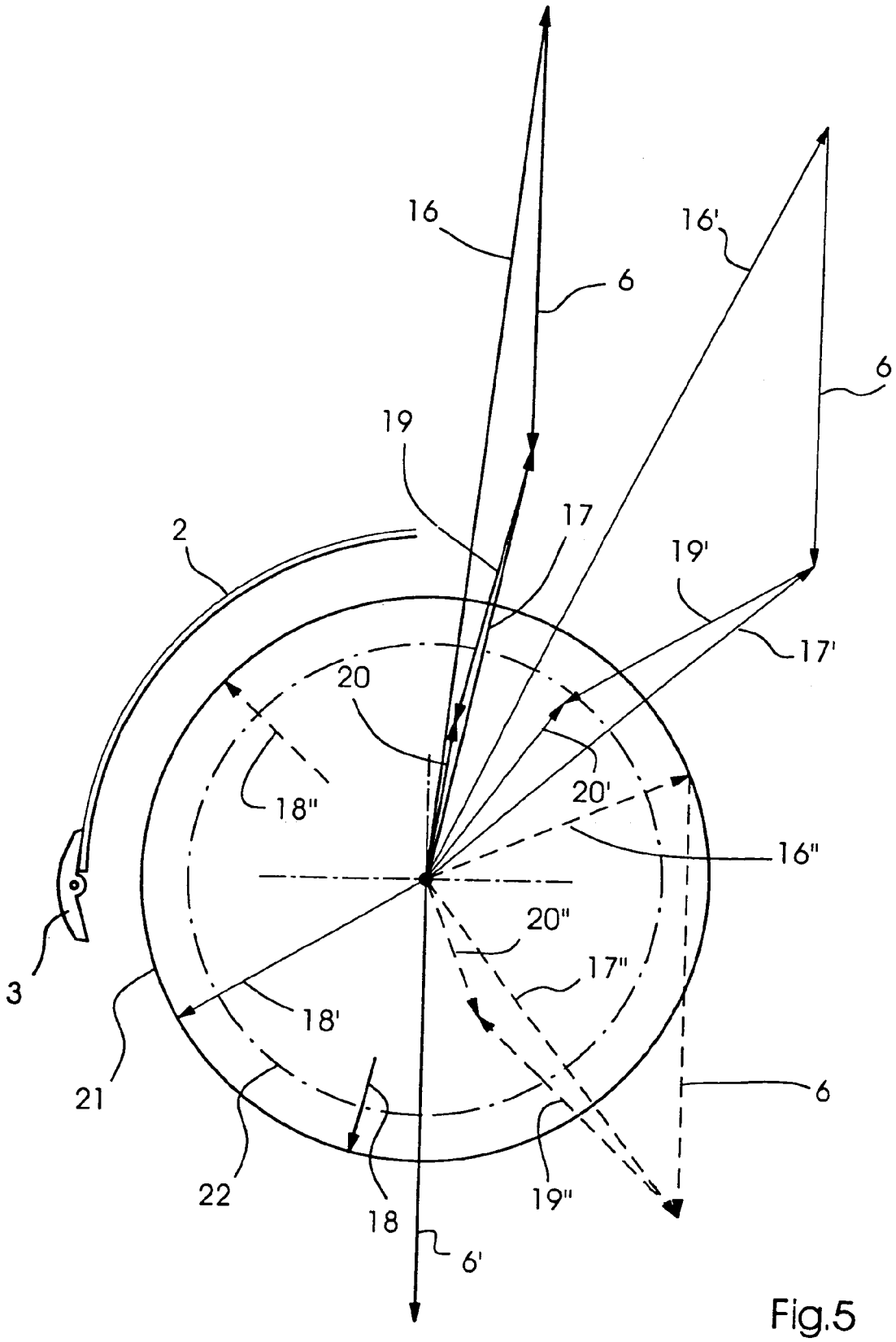
FIG. 5 is an illustration showing the imbalances and their reductions for different printing plate formats.

FIG. 5 shows in schematic form the imbalances and their reduction for different printing plates 2.

Here, different printing plate formats of a printing plate 2 are presented. Overall, imbalances 16, 16', 16" of three different plate formats from a printing plate repertoire are illustrated.

The positions of the variable mass elements 11 and 12, which are not illustrated here, in this case depend directly on the positions of the end clamps 4, likewise not shown, which are matched to the formats of the printing plates 2. The magnitude of variable imbalances 18, 18', 18" is constant. Only a direction of the variable imbalances 18, 18', 18" is displaced, depending on the position of the end clamps 4, that is to say on the formats of the printing plates 2. In this case, an end point of the imbalances 18, 18', 18" is in each case located on an imbalance circle 21 of the variable imbalance.

The fixed imbalance 6 is produced by the fixed mass elements 9 and 10. The fixed imbalance 6 initially reduces the plate imbalances 16, 16', 16" of the different printing plates 2. As a result of this reduction in the plate imbalances 16, 16', 16", first imbalances 17, 17', 17" result. These are reduced further by the variable imbalances 19, 19', 19", not related to the drum center here, which results in that residual imbalances 20, 20', 20" remain. The residual imbalances 20, 20', 20" in each case lie within an imbalance circle 22 of the residual imbalances. The radius of the imbalance circle 22 is in this case the maximum imbalance occurring of the resultant residual imbalances 20, 20', 20".

A printing plate repertoire which is provided for use in the printing plate exposer illustrated here can in this case contain still further printing plates. Overall, given the selection illustrated here, the resultant residual imbalance 20, 20', 20" will always remain within the imbalance circle 22.

Figure 6:
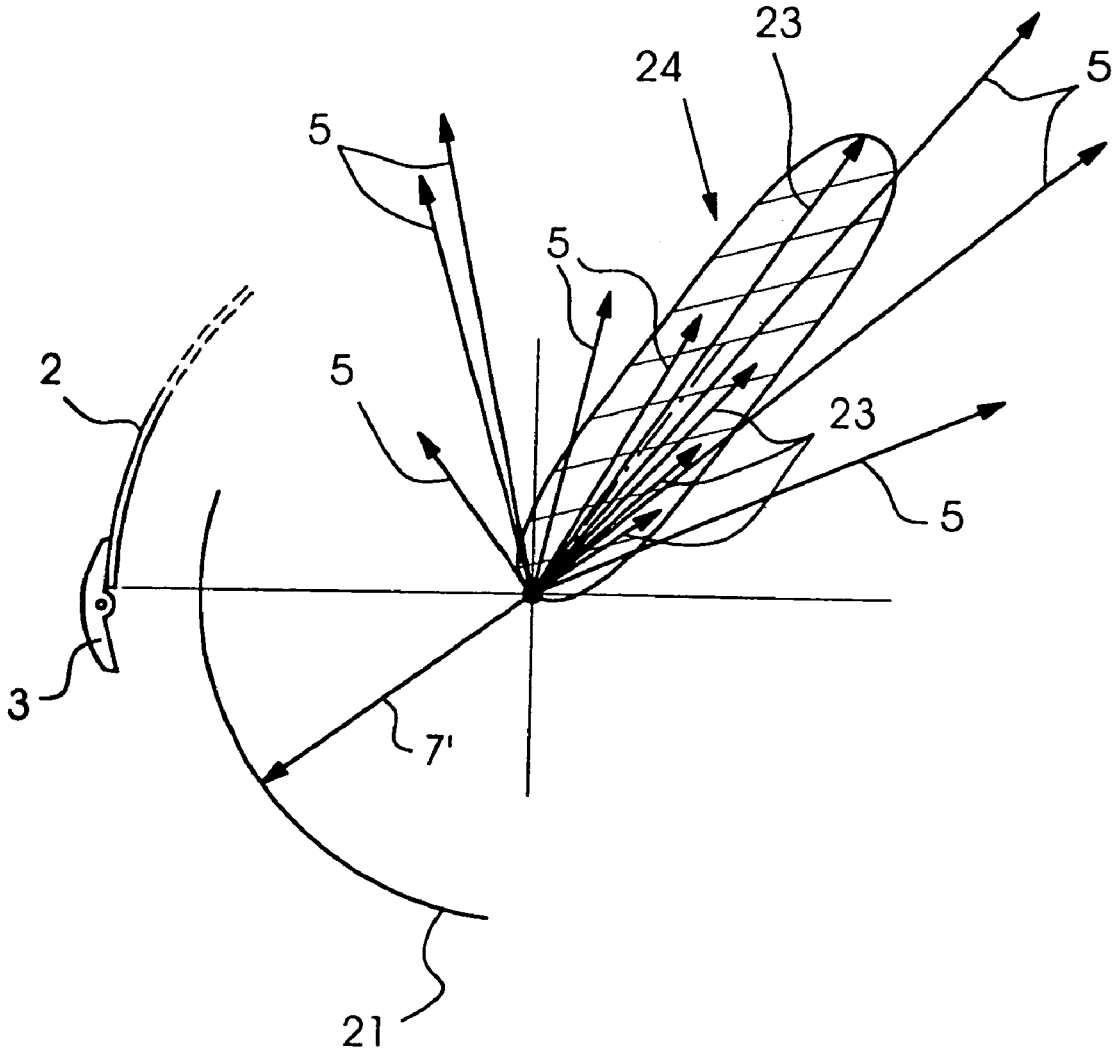
FIG. 6 is an illustration showing the reduction of different printing plate formats by variable mass elements.

FIG. 6 shows a further illustration of the imbalances of different printing plates 2 reduced by the variable mass elements 11, 12. Here, too, identical designations designate identical elements. By use of the mass of the variable mass elements 11, 12 and their relative positioning in relation to the end clamps 4, the plate imbalances 5 are in each case changed in terms of their direction and their magnitude in such a way that, for a specific plate portfolio, they lie within an imbalance lobe 24.

Figure 7:
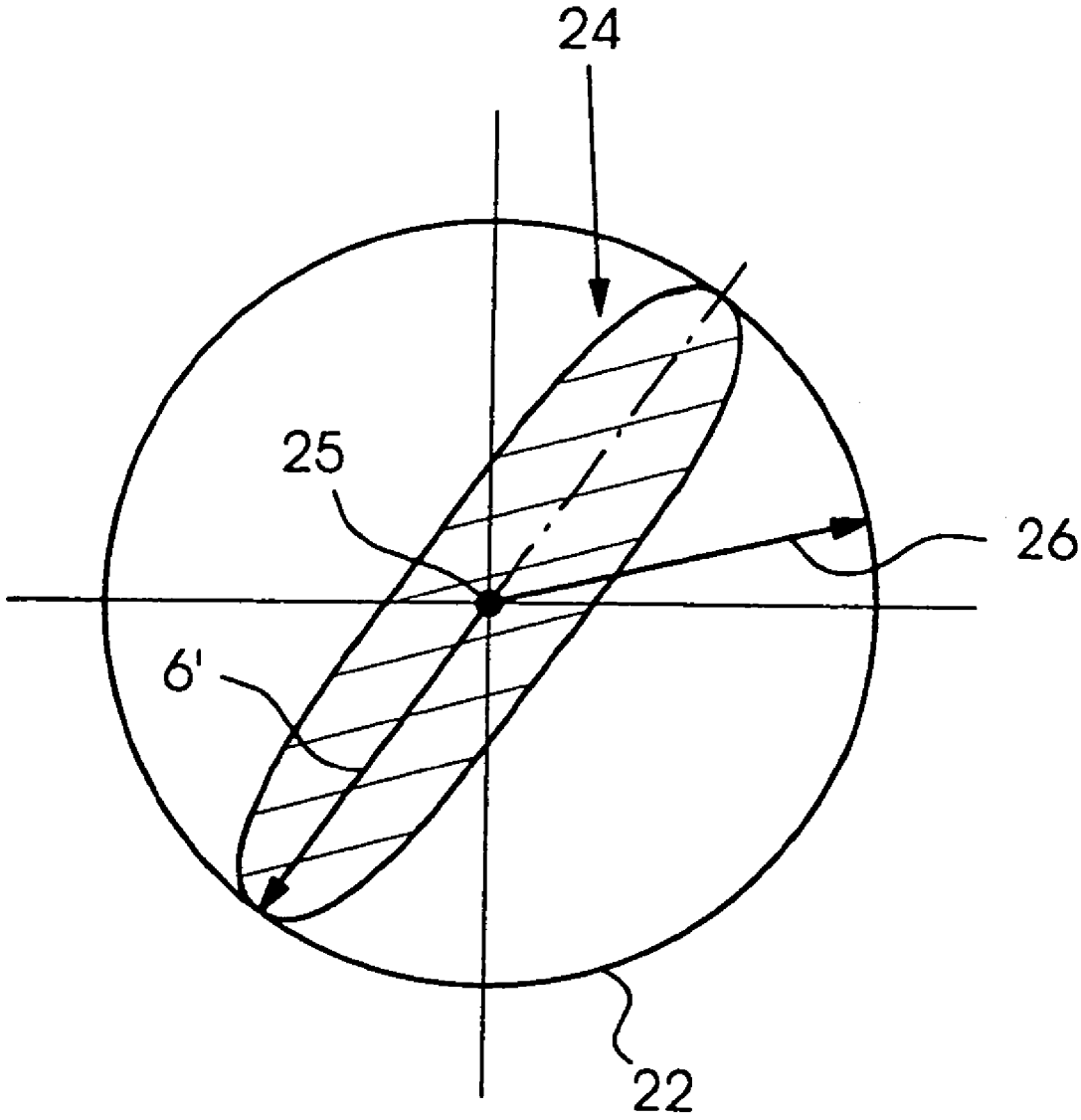
FIG. 7 is an illustration showing the reduction of the residual imbalances according to FIG. 6 by a fixed mass element.

FIG. 7 also shows an illustration of the fact that an imbalance lobe 24 of first resultant imbalances 23 is displaced by the fixed imbalance 6' such that the total imbalance lobe 24 remains within the imbalance circle 22 of the residual imbalances. In this case, the magnitude 26 of the maximum residual imbalance is the radius of this imbalance circle 22.

Since the masses of the variable and fixed mass elements 11, 12 and 9, 10 are constant and the position of the fixed mass elements 9, 10 is not varied, while the relative positions of the variable mass elements 11, 12 in relation to the plate end clamps 4 are always the same, the resultant residual imbalance 20, 20', 20" is always automatically kept within the imbalance circle 22; its magnitude 26 will never lie above a maximum value.

The magnitude 26 is determined by the masses of the mass elements 9, 10, 11, 12 and their position. It should be determined in such a way that a product Q of the resultant eccentricity E of the drum 1 with its angular velocity W always remains less than or equal to 4 mm/s. In this way, automatic balancing is made simply possible without special effort.

This application claims the priority, under 35 U.S.C. § 119, of German patent application No. 10 2005 022 239.0, filed May 13, 2005; the entire disclosure of the prior application is herewith incorporated by reference.

I claim:

1. A balancing system for balancing a drum of a printing plate exposer, the balancing system comprising:

at least one movable mass element moving substantially in a circumferential direction of the drum to reduce an imbalance of the drum, said at least one movable mass element being disposed on at least one end of the drum, said at least one movable mass element being substantially ring-shaped or disk-shaped and having an eccentric mass center of gravity, said at least one movable mass element including an engagement or groove;

at least one movable positioning element having a position correlating with a circumferential extent of a printing form held by the drum, said at least one movable mass element being coupled to said at least one movable positioning element such that a circumferential position of said at least one movable mass element being adjusted automatically on a basis of the circumferential extent of the printing form; and at least one driver coupling said at least one movable mass element to said at least one positioning element, said at least one driver engaging said engagement or groove.

2. The balancing system according to claim 1, wherein said at least one movable positioning element is a plate end clamp.

3. The balancing system according to claim 1, further comprising at least one fixed mass element for reducing the imbalance of the drum without the printing form.

4. The balancing system according to claim 3, wherein said at least one fixed mass element includes a first fixed mass element and a second fixed mass element, said second fixed mass element reducing a maximum imbalance of the drum with the printing form of an envisaged format.

5. The balancing system according to claim 4, wherein said at least one movable mass element is adjusted such that as a result of a superimposition of compensating imbalances caused by said at least one movable mass element and said second fixed mass element, a resultant imbalance of the drum with any desired printing form provided for use in each case remains below an envisaged maximum imbalance.

6. The balancing system according to claim 5, wherein a product of eccentricity and angular velocity of the drum for all the printing forms provided remains below a value of 4 mm per second.

7. The balancing system according to claim 3, wherein for a use of a first printing form having a first format, said at least one movable positioning element assumes a first position, and said at least one movable mass element is positioned such that a resultant residual imbalance of the drum remains below a maximum value; and wherein for a use of a second printing form having a second format, said at least one movable positioning element is adjusted into a second position, and a position of said at least one movable mass element is adjusted by a coupling to said at least one movable positioning element such that the resultant residual imbalance of the drum continues to remain below the maximum value.

8. The balancing system according to claim 7, wherein said at least one fixed mass element includes a first fixed mass element and a second fixed mass element, said second fixed mass element influences the resultant residual imbalance of the drum such that the residual imbalance in each case remains below the maximum value.

9. The balancing system according to claim 1, wherein said at least one positioning element includes a number of end clamps, said end clamps are fixed axially to the surface of the drum, and are displaced together, said end clamps include outer end clamps provided at ends of the drum, said outer end clamps are always connected to the at least moveable mass element by said drivers.

10. The balancing system according to claim 1, wherein a first said moveable mass element has a mass compensating for the at least one moveable positioning element in each case and a second moveable mass element having a mass and a position for reducing the imbalance from printing plates provided from a printing plate portfolio in each case.

11. The balancing system according to claim 1, wherein a fixed mass element is disposed and has a mass for correcting the imbalance caused by fixed positioning elements.

12. The balancing system according to claim 1, wherein said at least one moveable mass element includes a ring-shaped balance ring with two variable mass elements fitted to said balance ring, the first variable mass element compensating for the at least one moveable positioning element in each case and the second variable mass element compensating for printing plates from a printing plate portfolio.

13. A method for balancing a rotatable drum suitable for holding flat objects including printing forms, which comprises the steps of:

adjusting a position of at least one positioning element on a basis of a circumferential extent of a flat object;

providing at least one movable mass disposed on at least one end of the drum;

forming the at least one movable mass element as ring-shaped or disk-shaped with an eccentric mass center of gravity; and adjusting automatically a circumferential position of the at least one movable mass element in a manner coupled to an adjustment of the at least one positioning element so that the at least one movable mass element is subsequently positioned with at least one driver coupling the at least one movable mass element to the at least one positioning element by the driver engaging in an engagement or groove of the at least one moveable mass element such that an imbalance of the drum with the flat object is reduced.

14. The method according to claim 13, which further comprises forming the at least one positioning element as a plate end clamp.

15. A printing plate exposer, comprising:

a drum being a rotatable drum; and a balancing system for balancing said drum, said balancing system containing:

at least one movable mass element moving substantially in a circumferential direction of said drum for reducing an imbalance of said drum, said at least one movable mass element being disposed on at least one end of said drum, said at least one movable mass element being substantially ring-shaped or disk-shaped and having an eccentric mass center of gravity, said at least one movable mass element including an engagement or groove;

at least one movable positioning element having a position correlating with a circumferential extent of a printing form held by said drum, said at least one movable mass element being coupled to said at least one movable positioning element such that a circumferential position of said at least one movable mass element being adjusted automatically on a basis of the circumferential extent of the printing form resulting in a reduction of the imbalance of said drum; and at least one driver coupling said at least one movable mass element to said at least one positioning element, said at least one driver engaging said engagement or groove.

* * * * *